US011342107B2

(12) United States Patent
Choi

(10) Patent No.: US 11,342,107 B2
(45) Date of Patent: May 24, 2022

(54) CHIP ELECTRONIC COMPONENT

(71) Applicant: SAMSUNG ELECTRO-MECHANICS CO., LTD., Suwon-si (KR)

(72) Inventor: Kwang Sun Choi, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 402 days.

(21) Appl. No.: 16/011,886

(22) Filed: Jun. 19, 2018

(65) Prior Publication Data

US 2019/0198221 A1 Jun. 27, 2019

(30) Foreign Application Priority Data

Dec. 26, 2017 (KR) ..... 10-2017-0179517

(51) Int. Cl.

| | |
|---|---|
| ***H01F 27/32*** | (2006.01) |
| ***H01F 27/36*** | (2006.01) |
| ***H01F 27/255*** | (2006.01) |
| ***H01F 27/28*** | (2006.01) |
| ***H01F 17/04*** | (2006.01) |

(Continued)

(52) U.S. Cl.

CPC ..... *H01F 27/255* (2013.01); *H01F 17/0013* (2013.01); *H01F 17/04* (2013.01); *H01F 27/2804* (2013.01); *H01F 27/32* (2013.01); *H01F 27/324* (2013.01); *H01F 27/36* (2013.01); *H01F 2003/106* (2013.01)

(58) Field of Classification Search

CPC .... H01F 27/255; H01F 27/2804; H01F 17/04; H01F 17/0013; H01F 27/324; H01F 2003/106; H01F 27/34; H01F 1/0313; H01F 27/292; H01F 27/24; H01F 27/28; H01F 27/29; H01F 27/32; H01F 27/022; H01F 27/36

See application file for complete search history.

(56) References Cited

U.S. PATENT DOCUMENTS 6,392,525 B1 * 5/2002 Kato ..... H01F 3/08 336/200
6,888,435 B2 * 5/2005 Inoue ..... H01F 1/24 336/83
7,821,368 B1 10/2010 Yang et al.

(Continued)

FOREIGN PATENT DOCUMENTS

CN 1334575 A 2/2002
CN 102982931 A 3/2013

(Continued)

OTHER PUBLICATIONS

Office Action issued in corresponding Chinese Patent Application No. 201810945962.2 dated Oct. 29, 2020, with English translation.

*Primary Examiner* — Tuyen T Nguyen
(74) *Attorney, Agent, or Firm* — Morgan, Lewis & Bockius LLP

(57) ABSTRACT

A chip electronic component includes a magnetic body including first magnetic metal particles, internal coil portions embedded within the magnetic body, and insulation resistance layers disposed on upper and lower surfaces of the magnetic body and including second magnetic metal particles having an oxide coating.

11 Claims, 13 Drawing Sheets

(51) Int. Cl.
*H01F 17/00* (2006.01)
*H01F 3/10* (2006.01)

(56) References Cited

U.S. PATENT DOCUMENTS

| | | | | |
|---|---|---|---|---|
| 8,610,525 | B2 * | 12/2013 | Matsuura | H01F 17/0013 336/83 |
| 2002/0027764 | A1 | 3/2002 | Kishimoto et al. | |
| 2011/0090665 | A1 | 4/2011 | Korony et al. | |
| 2011/0233700 | A1 | 9/2011 | Hayakawa et al. | |
| 2012/0223798 | A1 | 9/2012 | Wei | |
| 2013/0113593 | A1 * | 5/2013 | Jeong | H01F 27/292 336/200 |
| 2013/0293334 | A1 * | 11/2013 | Shin | H01F 17/0033 336/192 |
| 2014/0132387 | A1 | 5/2014 | Shin | |
| 2014/0184374 | A1 * | 7/2014 | Park | H01F 17/0013 336/83 |
| 2015/0022305 | A1 | 1/2015 | Lee et al. | |
| 2015/0162124 | A1 | 6/2015 | Kim et al. | |
| 2015/0187484 | A1 | 7/2015 | Jeong et al. | |
| 2015/0371752 | A1 * | 12/2015 | Park | H01F 27/292 336/200 |
| 2016/0276089 | A1 | 9/2016 | Inoue et al. | |
| 2016/0293315 | A1 * | 10/2016 | Kim | H01F 41/046 |
| 2017/0140864 | A1 * | 5/2017 | Arai | H01F 1/0306 |
| 2017/0154720 | A1 | 6/2017 | Ohkubo et al. | |
| 2017/0236633 | A1 * | 8/2017 | Park | H01F 41/041 336/55 |

FOREIGN PATENT DOCUMENTS

| | | | |
|---|---|---|---|
| CN | 102246327 | B | 11/2013 |
| CN | 103811161 | A | 5/2014 |
| CN | 104299759 | A | 1/2015 |
| CN | 104700980 | A | 6/2015 |
| CN | 104766692 | A | 7/2015 |
| CN | 105845296 | A | 8/2016 |
| CN | 105989987 | A | 10/2016 |
| JP | 2008-166455 | A | 7/2008 |
| JP | 2017-103287 | A | 6/2017 |

* cited by examiner

CHIP ELECTRONIC COMPONENT

CROSS-REFERENCE TO RELATED APPLICATION

This application claims priority to Korean Patent Application No. 10-2017-0179517 filed on Dec. 26, 2017 in the Korean Intellectual Property Office, the disclosure of which is incorporated herein by reference in its entirety.

BACKGROUND

1. Field

The present disclosure relates to a chip electronic component.

2. Description of Related Art

An inductor is a type of chip electronic component and is a typical passive element that can be used to cancel noise by forming an electronic circuit together with a resistor and a capacitor.

A thin film type inductor is manufactured by forming an internal coil portion through plating, curing a magnetic powder/resin composite in which a magnetic powder and a resin are mixed to produce a magnetic body, and forming external electrodes externally on the magnetic body.

SUMMARY

An exemplary embodiment in the present disclosure is to provide a chip electronic component in which plating spreading to a surface thereof is prevented when external electrodes are formed, and a method of manufacturing the same.

An aspect of the present disclosure is to provide a chip electronic component in which a degradation of characteristics and a device breakage thereof may be prevented when an overvoltage is introduced, and a method of manufacturing the same.

According to an exemplary embodiment, a chip electronic component includes a magnetic body including a first magnetic metal particle, internal coil portions embedded within the magnetic body, and insulation resistance layers disposed on opposing upper and lower surfaces of the magnetic body. The insulation resistance layers include a second magnetic metal particle having an oxide coating.

According to another exemplary embodiment, a chip electronic component includes a magnetic body including first magnetic metal particles, internal coil portions embedded within the magnetic body, and insulation resistance layers disposed on upper and lower surfaces of the magnetic body. The insulation resistance layers include second magnetic metal particles each having a core and an oxide coating covering the core, and a D50 of the first magnetic metal particle and a D50 of the second magnetic metal particle are the same.

According to a further exemplary embodiment, an electronic component includes an internal coil having a plurality of coil windings surrounding a central hole, and a magnetic core portion embedding the internal coil and extending through the central hole. A surface of the magnetic core portion has an insulation resistance layer disposed thereon, and the insulation resistance layer includes magnetic particles coated with an oxide.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
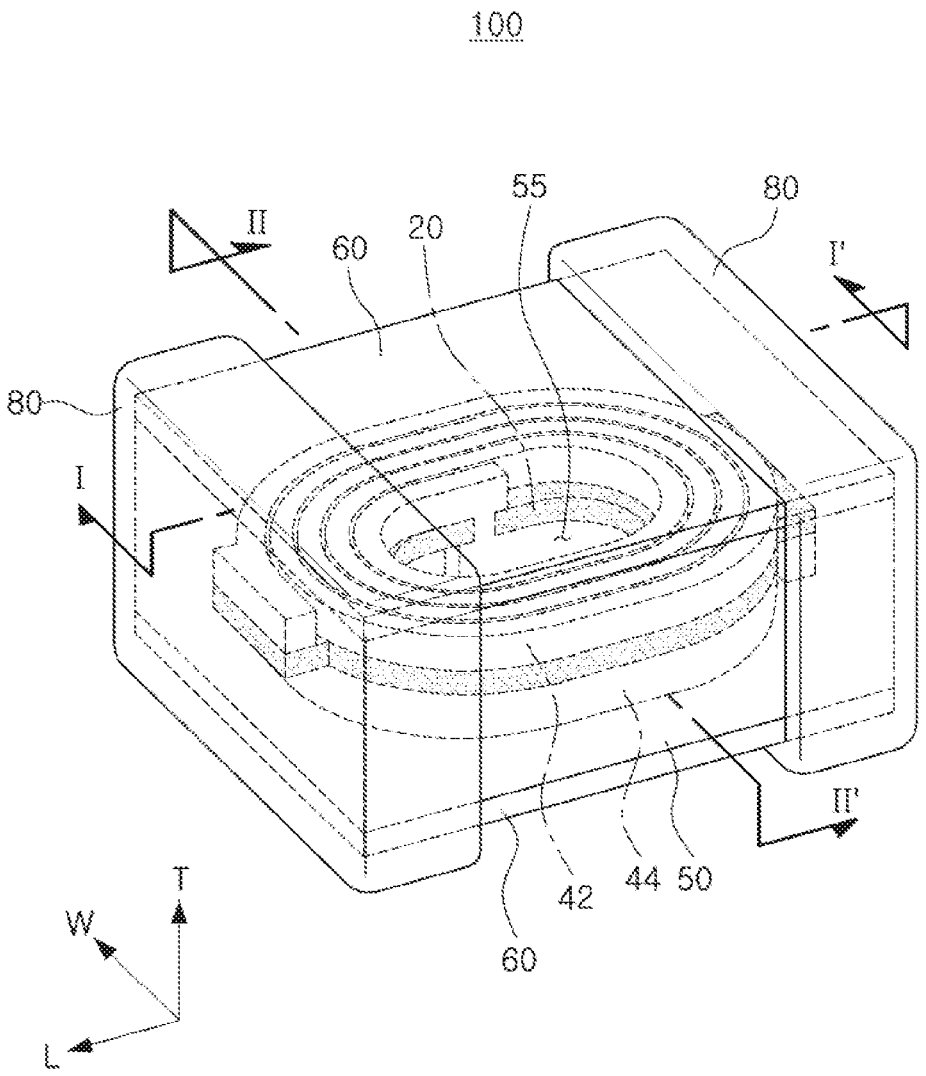
FIG. 1 is a perspective view of a chip electronic component according to an exemplary embodiment.

Hereinafter, exemplary embodiments in the present disclosure will be described in more detail with reference to the accompanying drawings. In the drawings, shapes, sizes, and the like, of components may be exaggerated for clarity.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be construed as being limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the embodiments.

Spatially relative terms, such as "above," "upper," "below," and "lower" and the like, may be used herein for ease of description to describe one element's positional relationship relative to other element (s) in the orientation shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both upward and downward orientations, depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein but should more generally be understood to include a change in shape results from manufacturing, for example. The following embodiments may also be constituted by one or a combination thereof.

The contents of the present disclosure described below may have a variety of configurations and only illustrative configuration as presented herein, but the disclosure is not limited thereto.

In the accompanying drawings, directions W, T, and L may denote a width direction, a thickness direction, and a length direction of a chip electronic component, respectively.

Chip Electronic Component

Hereinafter, a chip electronic component according to an exemplary embodiment, in detail, a thin film type inductor, will be described, but the disclosure is not limited thereto.

FIG. 1 is a perspective view illustrating a chip electronic component according to an exemplary embodiment.

Referring to FIG. 1, a thin film type inductor 100 used in a power line of a power supply circuit as an example of a chip electronic component is illustrated.

The chip electronic component 100 according to an exemplary embodiment includes a magnetic body 50, first and second internal coil parts 42 and 44 embedded in the magnetic body 50 and disposed on surfaces of a base layer 20, insulation resistance layers 60 disposed on upper and lower surfaces of the magnetic body 50, and external electrodes 80 disposed on outer surfaces of the magnetic body 50 and electrically connected to the first and second internal coil parts 42 and 44.

The magnetic body 50 includes first magnetic metal particles.

The first magnetic metal particles may be an alloy including at least one selected from the group consisting of Fe, Si, Cr, B, and Cu. For example, the first magnetic metal particles may include Fe—Si—B—Cr-based amorphous metal particles, but is not limited thereto.

The first magnetic metal particles may be included in a form in which the first magnetic metal particles are dispersed in a thermosetting resin such as an epoxy resin, an acrylic resin, a polyimide resin, or the like.

The magnetic body 50 may include the thermosetting resin and the first magnetic metal particles.

In the process of polishing the magnetic body cut into individual chip size, the magnetic metal particles may protrude from a surface of the magnetic body, and thus, for example, when a plating layer is subsequently formed on the external electrodes, the plating layer may also be formed on the protruding magnetic metal particles, resulting in a plating spreading defect.

Thus, in an exemplary embodiment, the above-mentioned problem may be solved by forming the insulation resistance layer 60 including magnetic metal particles having an oxide coating, on the upper and lower surfaces of the magnetic body 50. The insulation resistance layer 60 may cover the entire upper surface of the magnetic body 50 and the entire lower surface of the magnetic body 50.

Details of the insulation resistance layer 60 according to an exemplary embodiment will be described hereinafter.

The first internal coil part 42 having a coil-shaped pattern is formed on one surface of a base layer 20 disposed inside the magnetic body 50, and the second internal coil part 44 having a coil-shaped pattern is formed on the other surface of the base layer 20 opposing the one surface.

The base layer 20 is formed of, for example, a polypropylene glycol (PPG) substrate, a ferrite substrate, a metal-based soft magnetic substrate, or the like.

A central portion of the base layer 20 may have a hole formed to penetrate therethrough, and the hole is filled with the magnetic metal particles of the body 50 to form a core portion 55. Formation of the core portion 55 filled with the magnetic metal particles may improve inductance.

The first and second internal coil parts 42 and 44 may each be formed in a spiral shape. The first and second internal coil parts 42 and 44, formed on the one surface and on the other surface opposing the one surface of the base layer 20, may be electrically connected to each other by a via electrode 46 (see, e.g., FIG. 3) penetrating through the base layer 20.

The first and second internal coil parts 42 and 44 and the via electrode 46 may be formed to include a metal having excellent electrical conductivity. For example, the first and second internal coil parts 42 and 44 and the via electrode 46 may be formed of a metal such as silver (Ag), palladium (Pd), aluminum (Al), nickel (Ni), titanium (Ti), gold (Au), copper (Cu), platinum (Pt), or alloys thereof.

The first and second internal coil parts 42 and 44 may each be covered with an insulating layer. The insulating layer may be formed through an appropriate method such as a screen printing method, a process through exposure and development of a photoresist (PR), a spray coating process, or the like. The first and second internal coil parts 42 and 44 may be covered with the insulating layer, to be prevented from being in direct contact with a magnetic material included in the magnetic body 50.

One end of the first internal coil part 42 formed on one surface of the base layer 20 may be exposed to one end surface of the magnetic body 50 in the length direction, and one end of the second internal coil part 44 formed on the other surface opposing the one surface of the base layer 20 may be exposed to another end surface of the magnetic body 50 disposed opposite to the one end surface in the length direction.

The external electrodes 80 are formed on opposing end surfaces of the magnetic body 50 in the length direction, to be connected to the first and second internal coil parts 42 and 44 exposed to the opposing end surfaces of the magnetic body 50 in the length direction.

The external electrodes 80 may be formed to include a conductive metal having excellent electrical conductivity, and for example, may be formed of silver (Ag), nickel (Ni), copper (Cu), tin (Sn), or alloys thereof.

Figure 2:
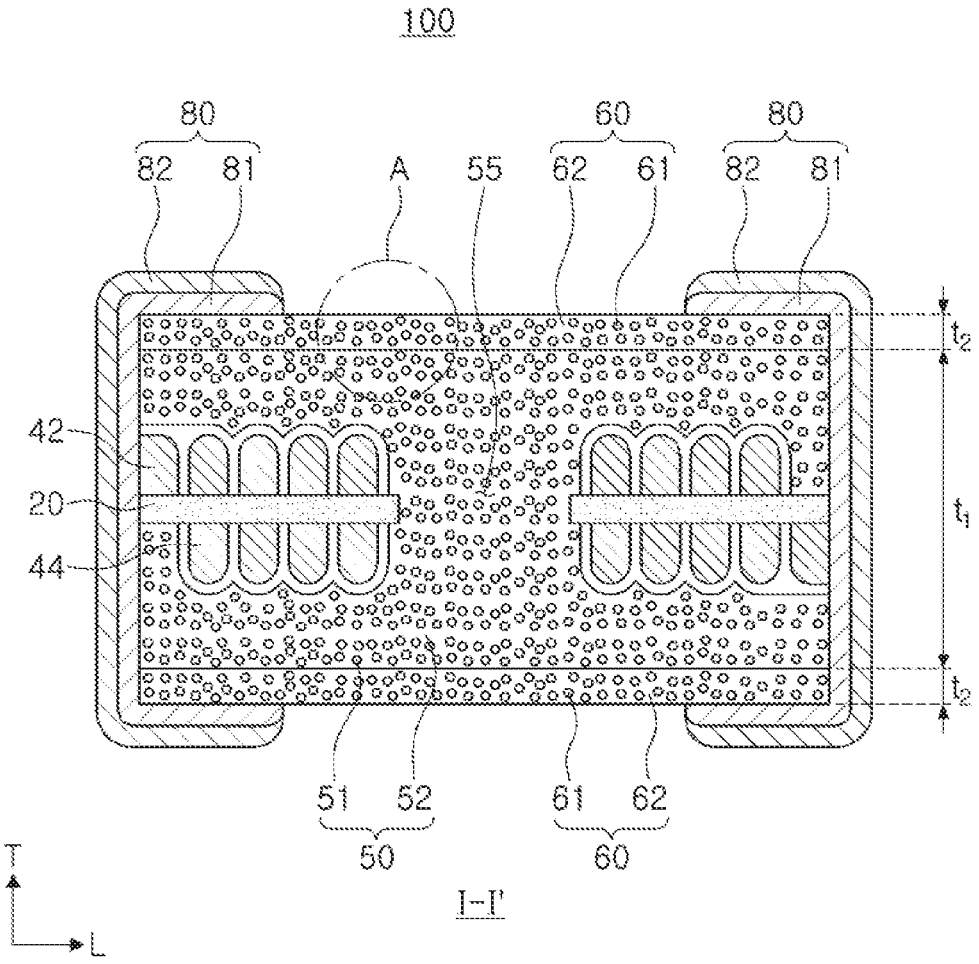
FIG. 2 is a cross-sectional view taken along line I-I' of FIG. 1.
Figure 3:
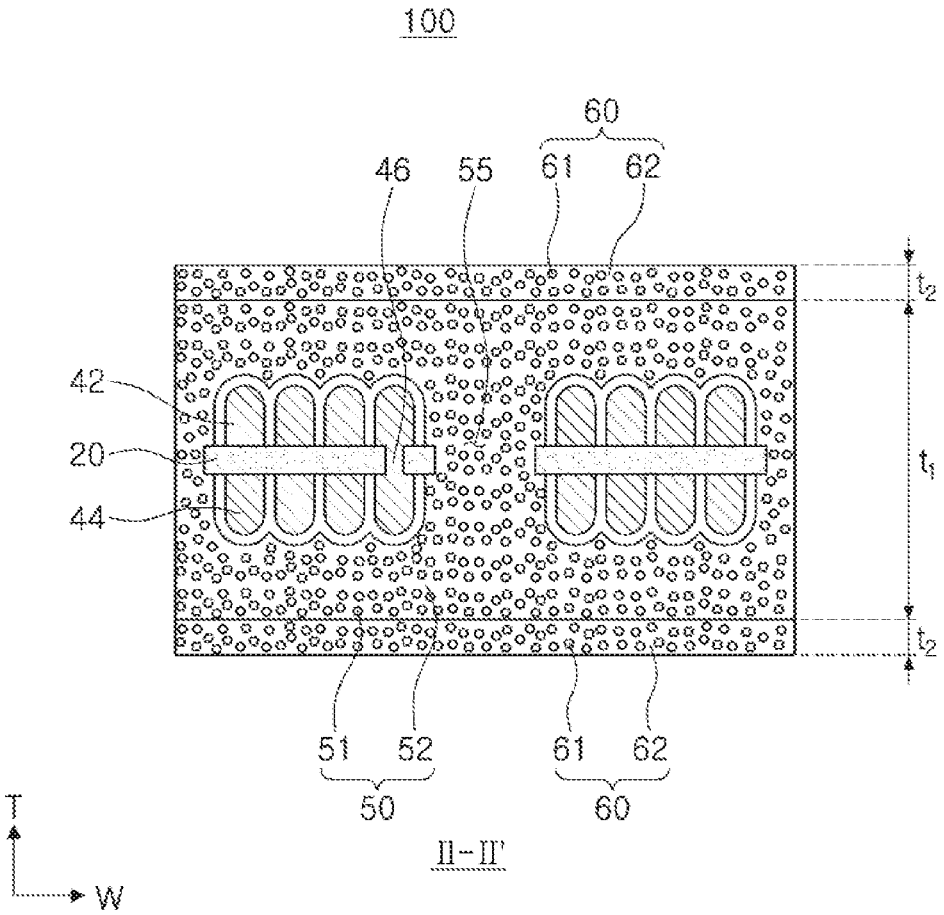
FIG. 3 is a cross-sectional view taken along line II-II' in FIG. 1.

FIG. 2 is a cross-sectional view taken along line I-I' of FIG. 1, and FIG. 3 is a cross-sectional view taken along line II-II' of FIG. 1.

Referring to FIGS. 2 and 3, the magnetic body 50 according to an exemplary embodiment includes first magnetic metal particles 51 and a first resin 52. The first magnetic metal particles 51 may be an alloy containing at least one selected from the group consisting of Fe, Si, Cr, B and Cu. The Fe content of the first magnetic metal particles 51 may be 85% or greater. The first resin 52 may be a thermosetting resin such as an epoxy resin, an acrylic resin, a polyimide resin, or the like.

D50 of the first magnetic metal particles 51 may be 0.1 μm to 25 μm. The D50 is measured using a particle diameter and particle size distribution measuring apparatus using a laser diffraction scattering method. The D50 measure may correspond to the average particle diameter by mass, and may indicate that half (by mass) of the particles have a diameter larger than the D50 size and half (by mass) of the particles have a diameter smaller than the D50 size. The particle diameter of the first magnetic metal particles 51 may be 0.1 μm to 50 μm.

The external electrodes 80 are formed on outer surfaces of the magnetic body 50 to be connected to the ends of the first and second internal coil parts 42 and 44. The external electrodes 80 may include an external electrode layer 81 formed using a conductive paste and a plating layer 82 formed on the external electrode layer through plating.

The external electrode layer 81 may be a conductive resin layer including at least one conductive metal selected from the group consisting of Cu, Ni, and Ag, and a thermosetting resin.

The plating layer 82 may include at least one selected from the group consisting of nickel (Ni), copper (Cu), and tin (Sn), and may include multiple layers with the same or different compositions. For example, a nickel layer and a tin (Sn) layer may be sequentially formed.

When plating is performed to form the plating layer 82, an unintended plating layer may be formed on the magnetic metal particle exposed to the surface of the magnetic body 50, resulting in a plating spreading defect.

However, according to an exemplary embodiment, the insulation resistance layer 60 is formed to include second magnetic metal particles 61 having an oxide coating 61*s* (see, e.g., FIG. 4), on the upper and lower surfaces of the magnetic body 50, to exhibit relatively high insulation resistance, such that plating spreading may be prevented. The insulation resistance layer 60 may be an anti-plating spreading layer. The insulation resistance layer 60 may cover the entire upper surface of the magnetic body 50 and may cover the entire lower surface of the magnetic body 50. The insulation resistance layer 60 includes the second magnetic metal particles 61 and a second resin 62. The second resin 62 may be a thermosetting resin such as an epoxy resin, an acryl resin, a polyimide resin or the like.

Figure 4:
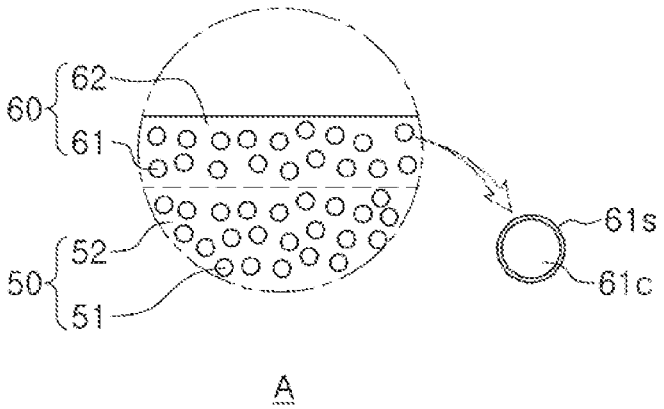
FIG. 4 is a schematic enlarged view illustrating an exemplary embodiment of portion 'A' of FIG. 2.

Referring to FIG. 4, the second magnetic metal particles 61 may each include a core 61*c* and the oxide coating 61*s* formed on a surface of the core 61*c*. The core 61*c* of the second magnetic metal particles 61 may be formed of an alloy including at least one selected from the group consisting of Fe, Si, Cr, B, and Cu. The Fe content of the core 61*c* of the second magnetic metal particles 61 may be 85 wt % or greater. The oxide coating 61*s* may be, for example, a chromium oxide coating. The oxide coating 61*s* may be formed by performing an oxidation thermal treatment on the core 61*c*. Surface insulation resistance of the insulation resistance layer 60 may be tens to hundreds of MΩ/cm. The insulation resistance layer 60 may have relatively high surface insulation resistance, as compared with a case in which the magnetic metal particles are coated with $SiO_2$ or a phosphate.

D50 of the second magnetic metal particles 61 may be the same as D50 of the first magnetic metal particles 51.

Since the insulation resistance layer 60 includes the second magnetic metal particles 61, a degradation of inductance caused as a thickness of the magnetic body 50 is reduced by forming the anti-plating spreading layer may be prevented. For example, since the insulation resistance layer 60 includes the second magnetic metal particles 61, the insulation resistance layer 60 may contribute to formation of inductance, as well as reducing a plating spreading phenomenon. When a thickness of the magnetic body 50 is referred to as t1 and a thickness of the insulation resistance layer 60 is referred to as t2, t2/t1 may be 0.25 or less.

The insulation resistance layer 60 has a relatively high surface withstand voltage, and thus, a degradation of device characteristics and device breakage when an overvoltage such as electrostatic discharge (ESD), or the like, is introduced may be prevented. The surface withstand voltage of the insulation resistance layer 60 may be 3.0 to $4.0\times10^4$ V/m. The insulation resistance layer 60 has a relatively high surface withstand voltage, as compared with a case of coating $SiO_2$ or phosphate.

Unlike the case of FIGS. 2 through 4, at least a portion of the second magnetic metal particles 61 may have a portion externally protruding from the second resin 62.

Figure 5:
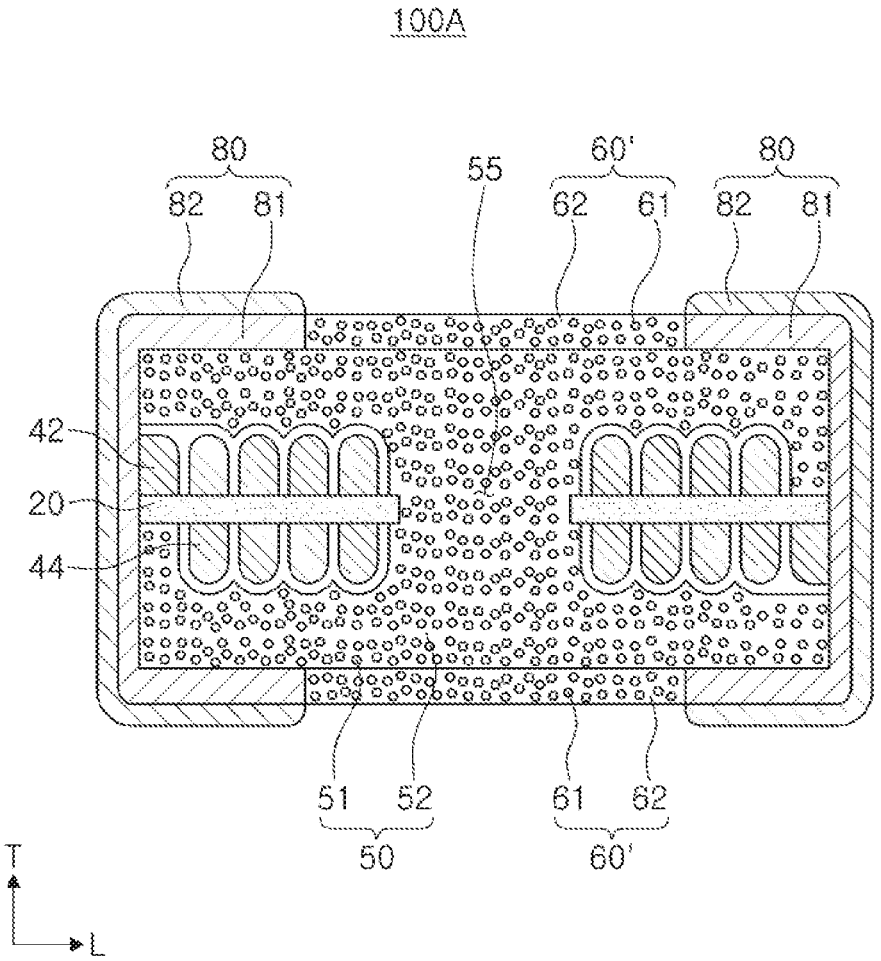
FIG. 5 is a cross-sectional view illustrating a chip electronic component according to another exemplary embodiment.

FIG. 5 is a cross-sectional view illustrating a chip electronic component according to an exemplary embodiment.

Referring to FIG. 5, a thin film type inductor 100A used in a power line of a power supply circuit is illustrated as an example of a chip electronic component. FIG. 5 is a cross-sectional view corresponding to FIG. 2. Hereinafter, differences of the chip electronic component 100A according to an exemplary embodiment, from the chip electronic component 100 of FIGS. 1 through 4, will largely be described.

The chip electronic component 100A according to an exemplary embodiment includes a magnetic body 50, first and second internal coil parts 42 and 44 embedded in the magnetic body 50, insulation resistance layers 60' disposed on upper and lower surfaces of the magnetic body 50, and external electrodes 80 disposed on outer surfaces of the magnetic body 50 to be electrically connected to the first and second internal coil portions 42 and 44.

According to an exemplary embodiment, the insulation resistance layer 60' including the second magnetic metal particles having the oxide coating 61*s* to exhibit relatively high insulation resistance is formed on the upper and lower surfaces of the magnetic body 50, thereby preventing plating spreading. The insulation resistance layer 60' may be an anti-plating spreading layer.

The external electrode layer 81 of the external electrode 80 may cover a portion of the upper surface and a portion of the lower surface of the magnetic body 50. The insulation resistance layer 60' may be formed on portions of upper and lower surfaces of the magnetic body 50 which are not covered by the external electrode layer 81. The insulation resistance layer 60' may be in contact with the external electrode layer 81. The insulation resistance layer 60' includes second magnetic metal particles 61 and second resin 62.

Figure 6:
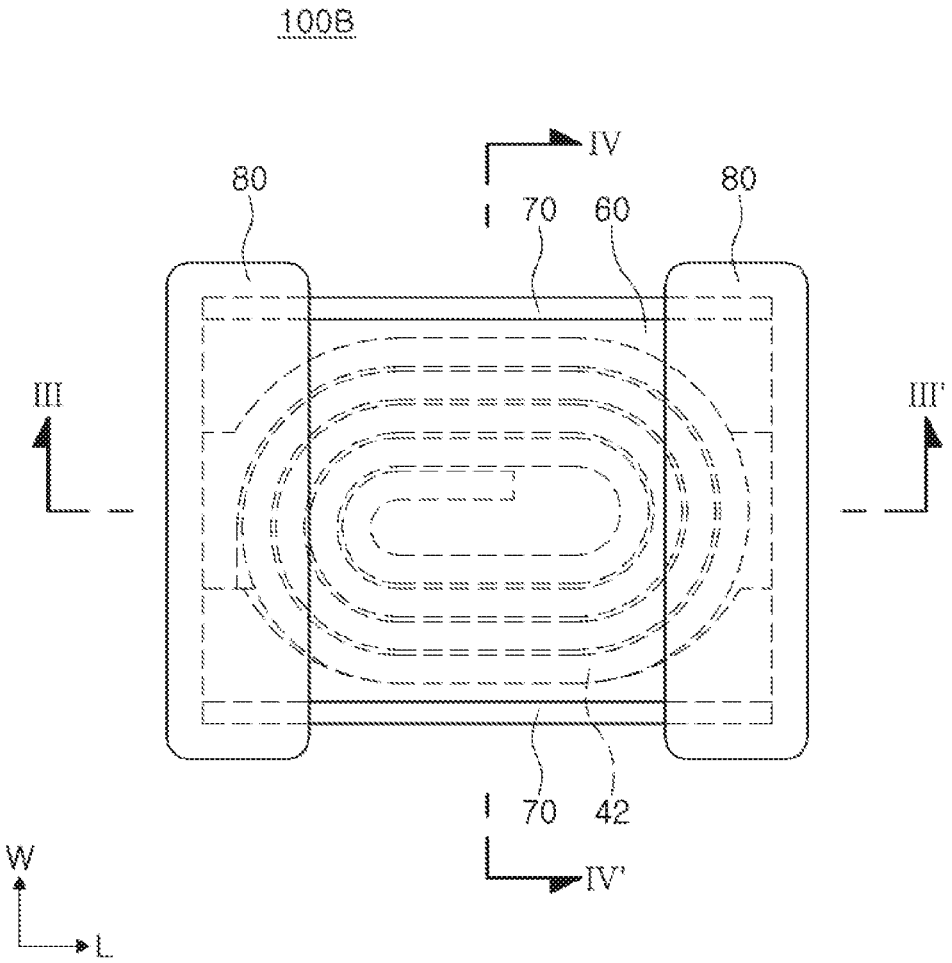
FIG. 6 is a plan view illustrating a chip electronic component according to a further exemplary embodiment.
Figure 7:
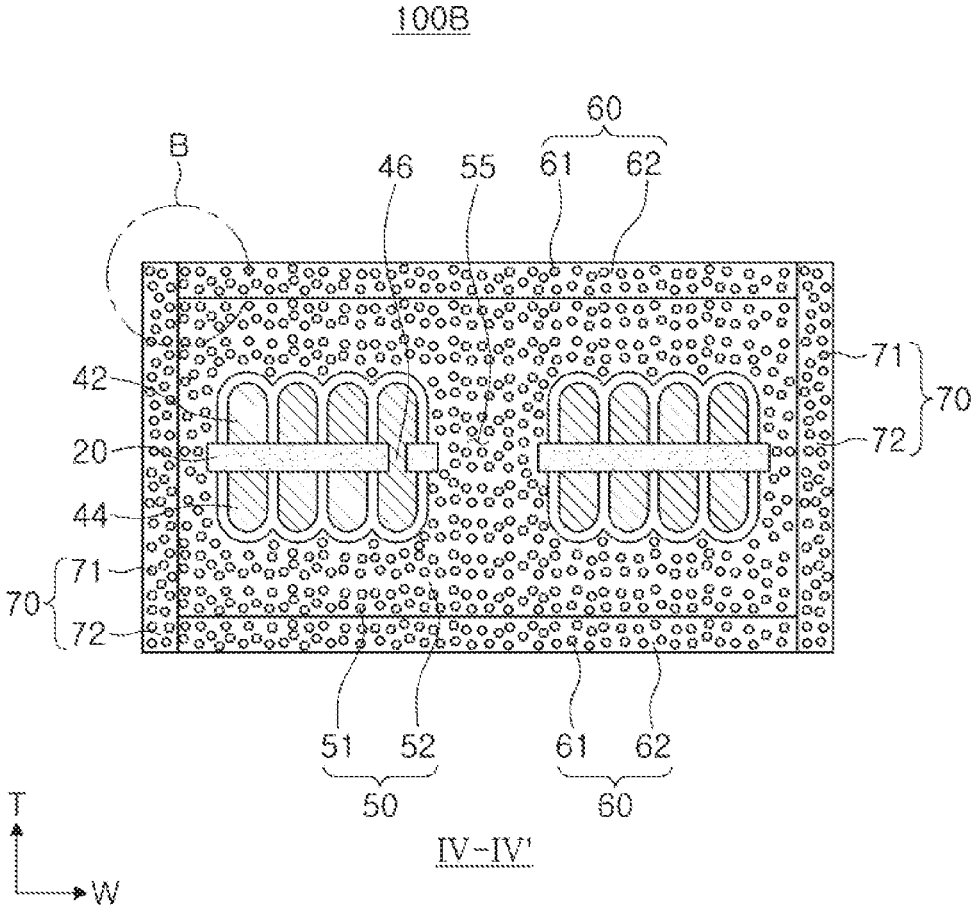
FIG. 7 is a cross-sectional view taken along line IV-IV' of FIG. 6.
Figure 8:
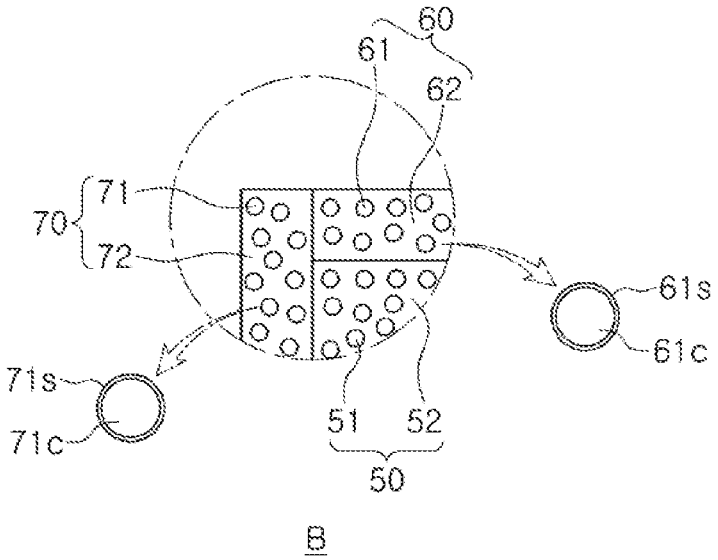
FIG. 8 is an enlarged schematic view of an exemplary embodiment of portion 'B' of FIG. 7.

FIG. 6 is a plan view illustrating a chip electronic component according to an exemplary embodiment. FIG. 7 is a cross-sectional view taken along line IV-IV' of FIG. 6. FIG. 8 is a schematic enlarged view of an exemplary embodiment of portion 'B' of FIG. 7. A cross-sectional view taken along line of FIG. 6 is the same as that of FIG. 2.

Referring to FIGS. 6 through 8, a thin film type inductor 100B used in a power line of a power supply circuit is illustrated as an example of a chip electronic component. Hereinafter, differences of the chip electronic component 100B, according to an exemplary embodiment, from the chip electronic component 100 of FIGS. 1 through 4, will largely be described.

The chip electronic component 100B according to an exemplary embodiment includes a magnetic body 50, first and second internal coil portions 42 and 44 embedded in the magnetic body 50, insulation resistance layers 60 and 70 disposed on upper and lower surfaces and opposing side surfaces of the magnetic body 50, and external electrodes 80 disposed on outer surfaces of the magnetic body 50 to be electrically connected to the first and second internal coil portions 42 and 44.

According to an exemplary embodiment, the insulation resistance layers 60 and 70 to exhibit high insulation resistance are formed on the upper and lower surfaces and opposing side surfaces of the magnetic body 50, preventing plating spreading. The insulation resistance layers 60 and 70 may be anti-plating spreading layers. The insulation resistance layer 60 may cover the entire upper surface of the magnetic body 50 and the entire lower surface of the magnetic body 50. Also, the insulation resistance layer 70 may cover the entire opposing side surfaces of the magnetic body 50. The external electrode 80 may cover portions of the insulation resistance layers 60 and 70.

The insulation resistance layer 60 includes the second magnetic metal particles 61 and the second resin 62. The insulation resistance layer 70 includes third magnetic metal particles 71 and a third resin 72. Surface insulation resistance of the insulation resistance layer 60 and the insulation resistance layer 70 may be tens to hundreds of MΩ/cm.

Referring to FIG. 8, the second magnetic metal particles 61 may include a core 61*c* and an oxide coating 61*s* formed on a surface of the core 61*c*. The third magnetic metal particles 71 may include a core 71*c* and an oxide coating 71*s* formed on a surface of the core 71*c*. The core 71*c* of the third magnetic metal particles 71 may be an alloy including at least one selected from the group consisting of Fe, Si, Cr, B, and Cu. The Fe content of the core 71*c* of the third magnetic metal particles 71 may be 85% or greater. The oxide coating 71*s* may be, for example, a chromium oxide coating.

D50 of the second magnetic metal particles 61 may be the same as D50 of the first magnetic metal particles 51. D50 of the third magnetic metal particles 71 may be the same as D50 of the first magnetic metal particles 51.

Figure 9:
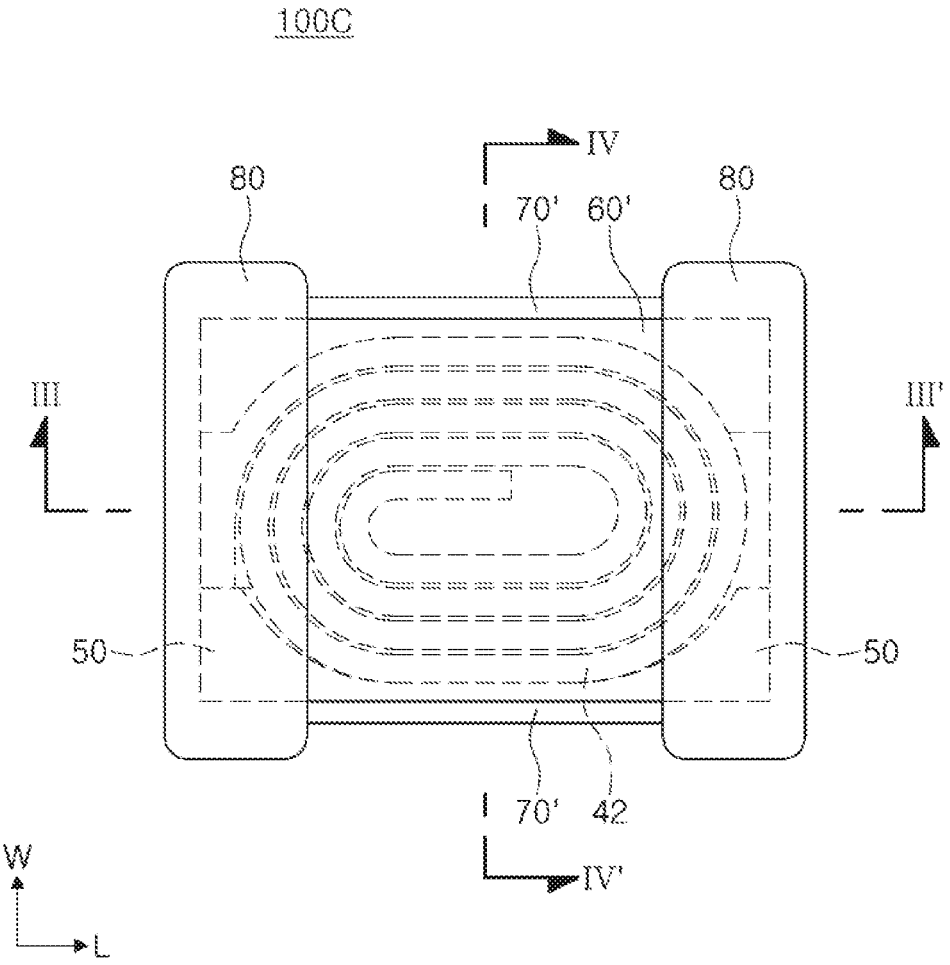
FIG. 9 is a plan view illustrating a chip electronic component according to a further exemplary embodiment.

FIG. 9 is a plan view illustrating a chip electronic component according to an exemplary embodiment.

The cross-sectional view taken along line of FIG. 9 is the same as that of FIG. 5, and the cross-sectional view taken along line IV-IV' of FIG. 9 is the same as FIG. 7.

Referring to FIG. 9, a thin film type inductor 100C used in a power line of a power supply circuit is illustrated as an example of a chip electronic component. Hereinafter, differences of the chip electronic component 100C according to an exemplary embodiment from the chip electronic component 100 of FIGS. 1 through 4 will largely be described.

The chip electronic component 100C according to an exemplary embodiment includes a magnetic body 50, first and second internal coil portions 42 and 44 embedded in the magnetic body 50, insulation resistance layers 60' and 70' disposed on upper and lower surfaces and opposing side surfaces of the magnetic body 50, and external electrodes 80 disposed on outer surfaces of the magnetic body 50 to be electrically connected to the first and second internal coil portions 42 and 44.

According to an exemplary embodiment, the insulation resistance layers 60' and 70' to exhibit relatively high insulation resistance are formed on the upper and lower surfaces and opposing side surfaces of the magnetic body 50, preventing plating spreading. The insulation resistance layers 60' and 70' may be anti-plating spreading layers.

The external electrode layer 81 of the external electrode 80 may cover a portion of an upper surface and a portion of a lower surface of the magnetic body 50. The insulation resistance layer 60' may be formed on portions of upper and lower surfaces of the magnetic body 50 not covered by (e.g., free of) the external electrode layer 81. The external electrode layers 81 of the external electrodes 80 may cover portions of opposing side surfaces of the magnetic body 50. The insulation resistance layer 70' may be formed on portions of opposing side surfaces of the magnetic body 50 not covered by (e.g., free of) the external electrode layers 81. The insulation resistance layers 60' and 70' may be in contact with the external electrode layers 81.

The insulation resistance layer 60' includes second magnetic metal particles 61 and a second resin 62. The insulation resistance layer 70' includes third magnetic metal particles 71 and a third resin 72.

Method of Manufacturing Chip Electronic Component

Figure 10:
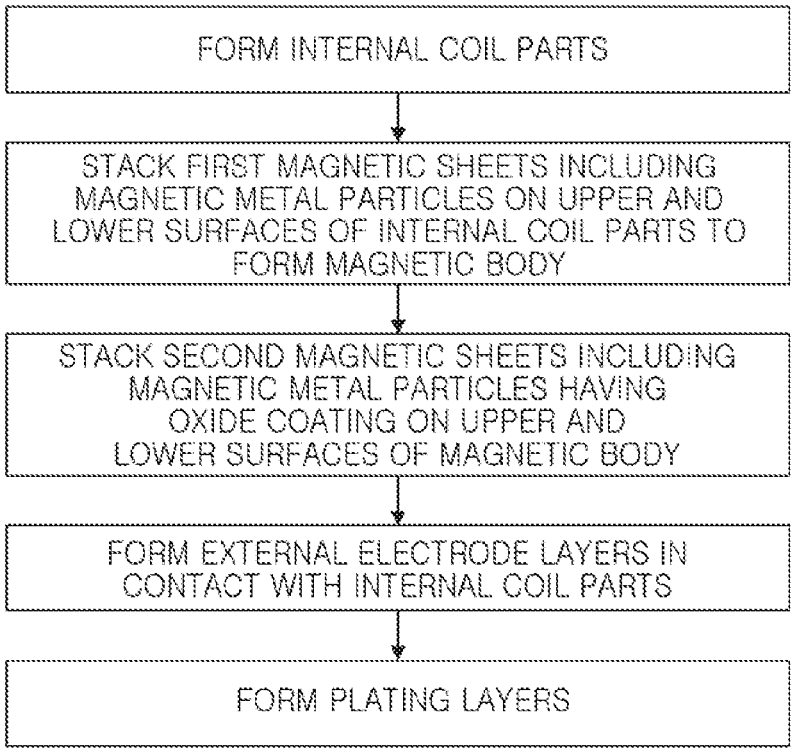
FIG. 10 is a flowchart illustrating a process of manufacturing a chip electronic component according to an exemplary embodiment.

FIG. 10 is a flowchart illustrating a process of manufacturing a chip electronic component according to an exemplary embodiment. FIGS. 11A through 11D are sequential views illustrating steps of a process of manufacturing a chip electronic component according to an exemplary embodiment. The process is for manufacturing a plurality of chip electronic components, but FIGS. 11A through 11D illustrate a process of manufacturing a single chip electronic component. FIGS. 10 and 11A through 11D are views illustrating a method of manufacturing the chip electronic component 100 of FIG. 4.

Figure 11A:
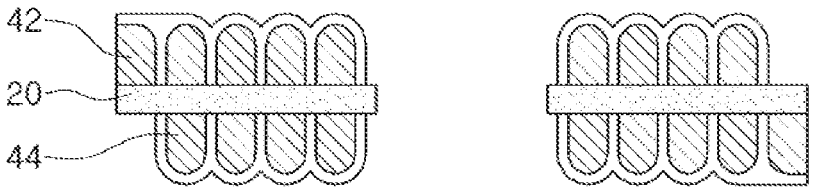
FIGS. 11A through 11D are views illustrating sequential steps of a process of manufacturing a chip electronic component according to an exemplary embodiment.

Referring to FIGS. 10 and 11A, the first and second internal coil parts 42 and 44 are formed on one surface and the other surface opposing the one surface of the base layer 20, respectively.

The first and second internal coil parts 42 and 44 may be formed by, for example, electroplating, but the forming method thereof is not limited thereto. The first and second internal coil parts 42 and 44 may be formed of a metal having excellent electrical conductivity, for example, silver (Ag), palladium (Pd), aluminum (Al), nickel (Ni), Titanium (Ti), gold (Au), copper (Cu), platinum (Pt), or alloys thereof.

An insulating layer may be formed on the surfaces of the first and second internal coil parts 42 and 44. The insulating layer may be formed by a known method such as a screen printing method, a process through exposure and development of a photoresist (PR), a spray coating process, and the like.

Figure 11B:
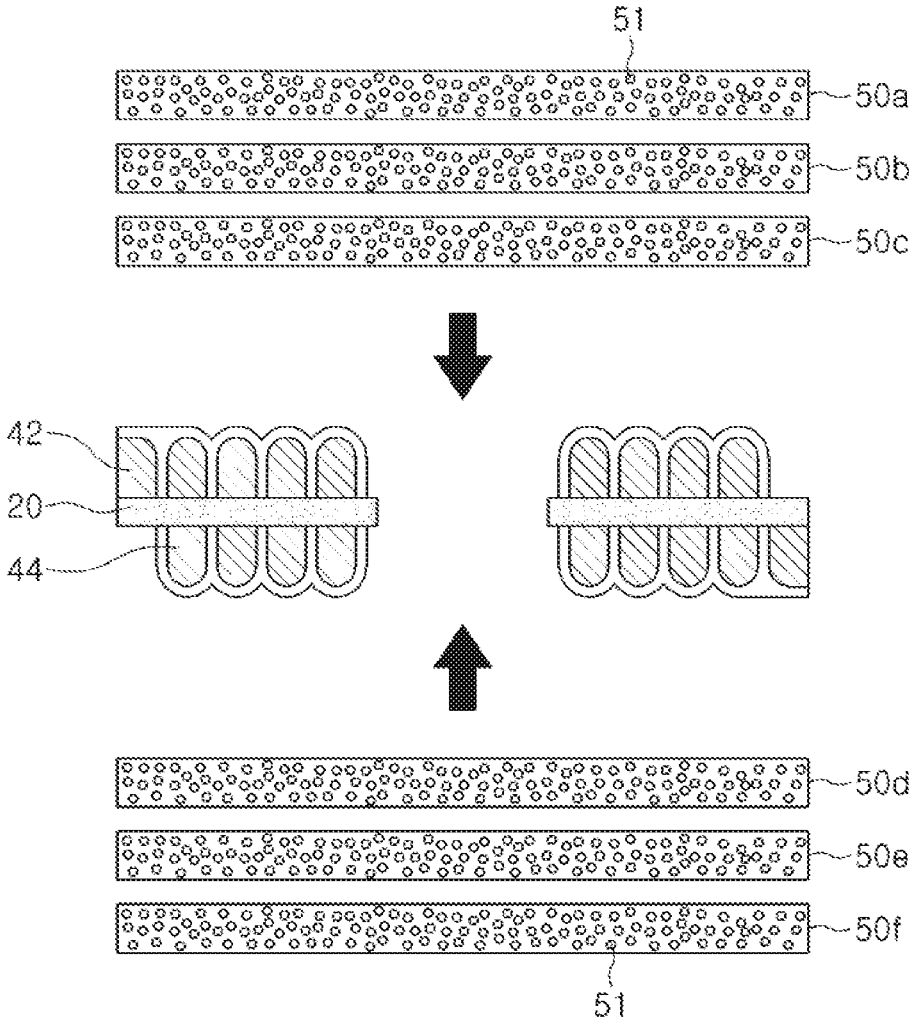

Referring to FIGS. 10 and 11B, a plurality of first magnetic sheets 50*a*, 50*b*, 50*c*, 50*d*, 50*e*, and 50*f* are stacked on upper and lower surfaces of the first and second internal coil parts 42 and 44 to form the magnetic body 50.

The first magnetic sheets 50*a*, 50*b*, 50*c*, 50*d*, 50*e*, and 50*f* may be formed by mixing first magnetic metal particles 51 with an organic material such as a binder, a solvent, and the like, to prepare a slurry, applying the slurry to a carrier film to have a thickness of tens of μm through a doctor blade method, and subsequently drying the same to form a sheet.

The plurality of first magnetic sheets 50*a*, 50*b*, 50*c*, 50*d*, 50*e*, and 50*f* are staked, and then, are compressed through a lamination method or a hydrostatic pressing method and cured to form the magnetic body 50.

The first magnetic sheets 50*a*, 50*b*, 50*c*, 50*d*, 50*e*, and 50*f* may each include the first magnetic metal particles 51.

Figure 11C:
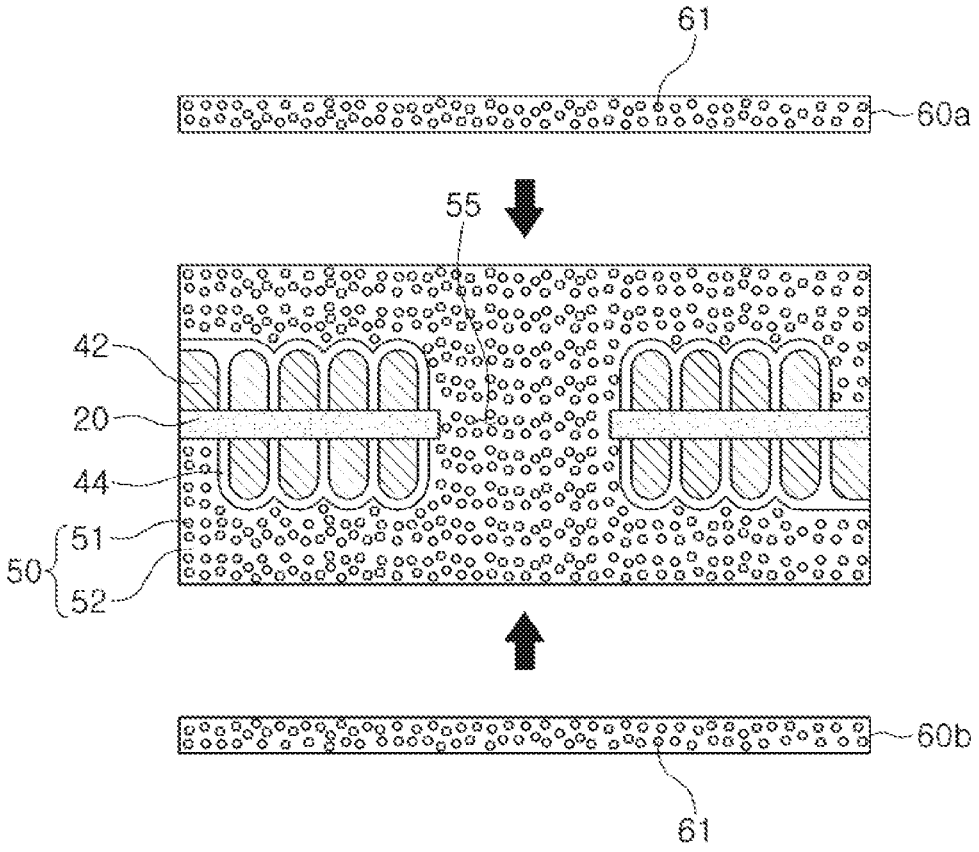

Referring to FIGS. 10 and 11C, second magnetic sheets 60*a* and 60*b* are stacked on the upper and lower surfaces of the magnetic body 50 to form the insulation resistance layer 60.

The second magnetic sheets 60*a* and 60*b* are prepared by mixing the second magnetic metal particles 61 with an organic material such as a binder, a solvent, and the like, to prepare a slurry, applying the slurry to a carrier film to have a thickness of tens of μm through a doctor blade method, and subsequently drying the same to form a sheet.

The second magnetic metal particles 61 may include the core 61*c* and the oxide coating 61*s* formed on the surface of the core 61*c* as illustrated in FIG. 4.

The second magnetic sheets 60*a* and 60*b* may be stacked and compressed by a lamination method or a hydrostatic pressing method to form the insulation resistance layer 60.

Figure 11D:
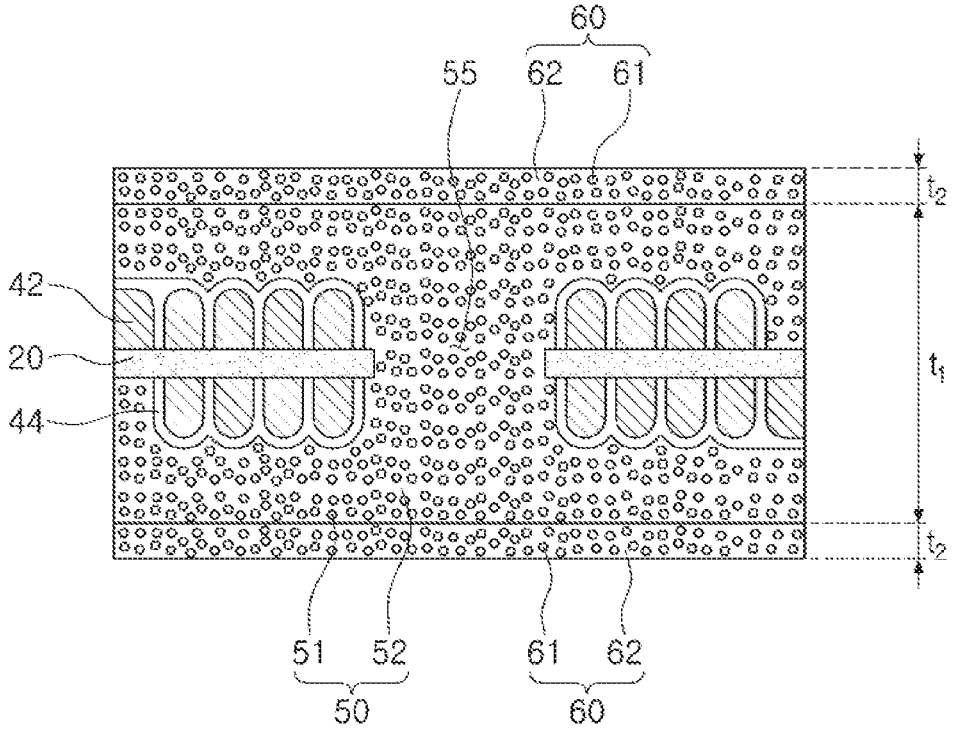

Referring to FIG. 11D, when a thickness of the magnetic body 50 is t1 and a thickness of the insulation resistance layer 60 is t2, the magnetic body 50 and the insulation resistance layer 60 may be formed such that t2/t1 is 0.25 or less.

Referring back to FIG. 2, the external electrodes 80 are formed on opposing end surfaces of the magnetic body 50 in the length direction such that the external electrodes 80 are connected to end portions of the first and second internal coil parts 42 and 44 exposed to opposing end surfaces of the magnetic body 50 in the length direction.

First, the external electrode layers 81 are formed on opposing end surfaces of the magnetic body 50 in the length direction and the plating layers 82 are formed on the external electrode layers 81.

The external electrode layers 81 are formed of a conductive resin layer using a paste containing at least one conductive metal selected from the group consisting of copper (Cu), nickel (Ni) and silver (Ag) and a thermosetting resin. For example, the external electrode layers 81 may be formed through a dipping method, or the like.

For example, a nickel (Ni) layer and a tin (Sn) layer may be sequentially formed to form the plating layer 82.

In an exemplary embodiment in the present disclosure, the insulation resistance layer 60 may be formed on upper and lower surfaces of the magnetic body 50 to prevent a plating spreading phenomenon that a plating layer is formed on a surface of the magnetic body 50 during plating to form the plating layer 82 of the external electrodes 80.

Figure 12:
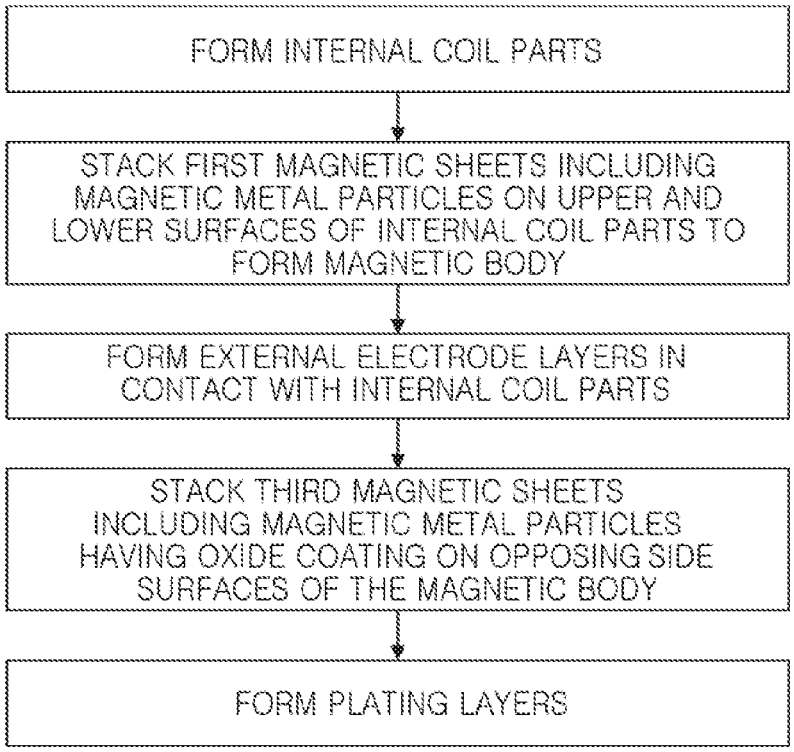
FIGS. 12 through 14 are flowcharts illustrating processes of manufacturing chip electronic components according to various exemplary embodiments.
Figure 13:
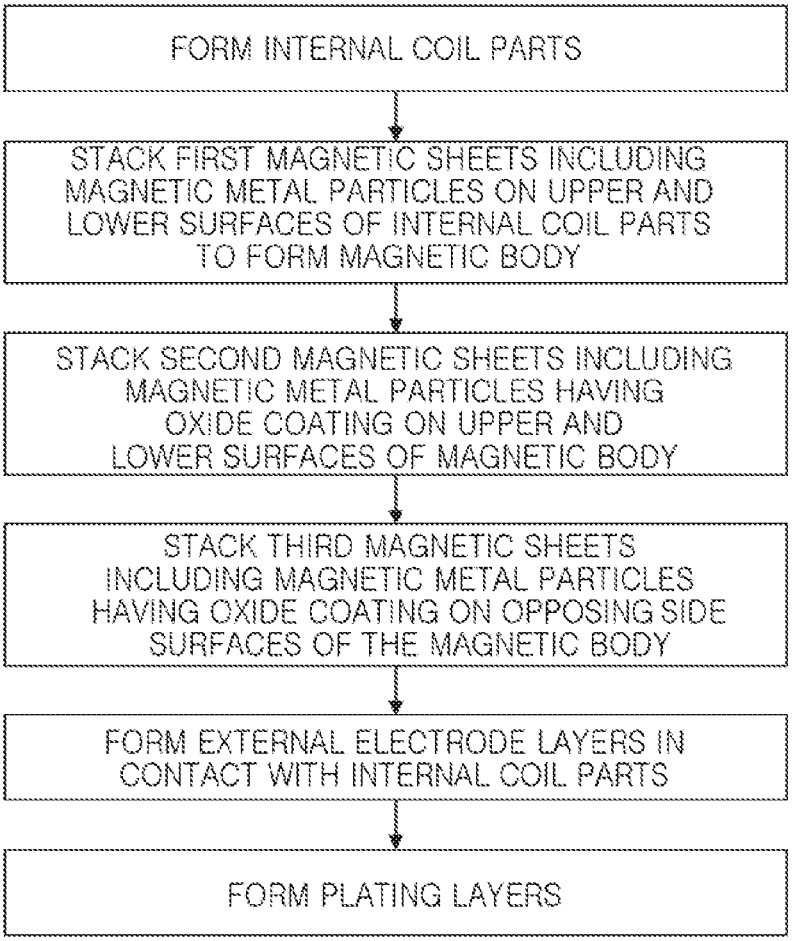
Figure 14:
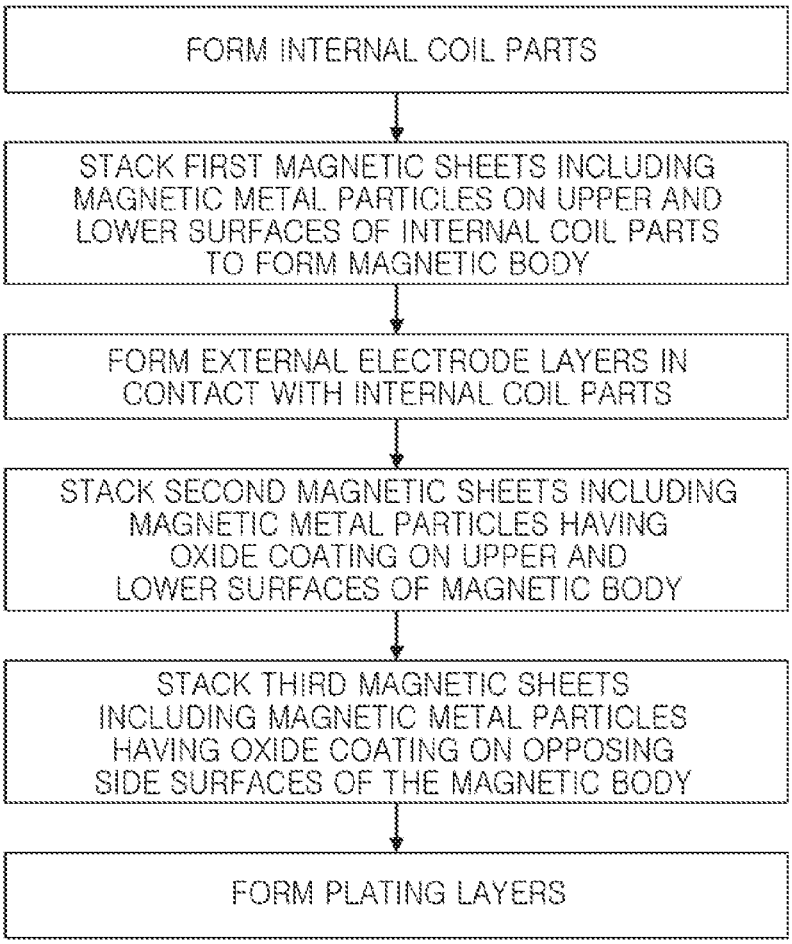

FIGS. 12 through 14 are flowcharts illustrating a process of manufacturing a chip electronic component according to exemplary embodiments.

FIG. 12 is a view illustrating a method of manufacturing the chip electronic component 100A of FIG. 5.

Referring to FIG. 12, the first and second internal coil parts 42 and 44 are formed on one surface and the other surface opposing the one surface of the base layer 20, respectively.

A plurality of first magnetic sheets including the first magnetic metal particles 51 are laminated on the upper and lower surfaces of the first and second internal coil portions 42 and 44 to form the magnetic body 50.

The external electrode layers 81 are formed on opposing end surfaces of the magnetic body 50 in the length direction such that the external electrode layers 81 are connected to the first and second internal coil portions 42 and 44 exposed to the opposing end surfaces of the magnetic body 50 in the length direction. The external electrode layers 81 of the external electrodes 80 are further formed to cover a portion of an upper surface and a portion of a lower surface of the magnetic body 50.

The second magnetic sheets including the second magnetic metal particles 61 are stacked on portions of the upper and lower surfaces of the magnetic body 50 not covered by the external electrode layer 81 to form the insulation resistance layer 60'.

Finally, the plating layer 82 is formed on the external electrode layer 81.

FIG. 13 is a view illustrating a method of manufacturing the chip electronic component 100B of FIGS. 6 through 8.

Referring to FIG. 13, the first and second internal coil parts 42 and 44 are formed on one surface and the other surface opposing the one surface of the base layer 20.

A plurality of first magnetic sheets including the first magnetic metal particles 51 are stacked on the upper and lower surfaces of the first and second internal coil portions 42 and 44 to form the magnetic body 50.

The second magnetic sheets including the second magnetic metal particles 61 are stacked on the upper and lower surfaces of the magnetic body 50 to form the insulation resistance layer 60. The third magnetic sheets including the third magnetic metal particles 71 are stacked on opposing side surfaces of the magnetic body 50 to form the insulation resistance layers 70.

The external electrode layers 81 are formed on opposing end surfaces of the magnetic body 50 in the length direction, to be connected to the first and second internal coil parts 42 and 44 exposed to the opposing end surfaces of the magnetic body 50 in the length direction. The plating layers 82 are formed on the external electrode layers 81.

FIG. 14 is a view illustrating a method of manufacturing the chip electronic component 100C of FIG. 9.

Referring to FIG. 14, the first and second internal coil parts 42 and 44 are formed on one surface and the other surface opposing the one surface of the base layer 20, respectively.

A plurality of first magnetic sheets including the first magnetic metal particles 51 are stacked on the upper and lower surfaces of the first and second internal coil parts 42 and 44 to form the magnetic body 50.

The external electrode layers 81 are formed on opposing end surfaces of the magnetic body in the length direction to be connected to the first and second internal coil parts 42 and 44 exposed to the opposing end surfaces of the magnetic body 50 in the length direction. The external electrode layers 81 of the external electrodes 80 are further formed to cover a portion of an upper surface and a portion of a lower surface of the magnetic body 50, and are further formed to cover portions of opposing side surfaces of the magnetic body 50.

The second magnetic sheets including the second magnetic metal particles 61 are stacked on portions of the upper and lower surfaces of the magnetic body 50 not covered by the external electrode layers 81 to form the insulation resistance layers 60'.

The third magnetic sheets including the third magnetic metal particles 71 are stacked on portions of opposing side surfaces of the magnetic body 50 not covered by the external electrode layers 81 to form the insulation resistance layers 70'.

The plating layers 82 are formed on the external electrode layers 81.

As set forth above, according to exemplary embodiments, plating spreading that may occur on the surface of the chip electronic component during plating may be prevented.

According to an exemplary embodiment, a degradation of device characteristics and a device breakage of the chip electronic component may be prevented when an overvoltage is introduced.

While exemplary embodiments have been shown and described above, it will be apparent to those skilled in the art that modifications and variations could be made without departing from the scope of the present disclosure as defined by the appended claims.

What is claimed is:

1. A chip electronic component comprising:

a magnetic body including first magnetic metal particles;

internal coil parts embedded within the magnetic body; and insulation resistance layers disposed on opposing upper and lower surfaces of the magnetic body, and including second magnetic, conductive metal particles, wherein at least one of the first magnetic metal particles includes an oxide layer, and wherein at least one of the at least one of the first magnetic metal particles does not include a same oxide layer as an oxide coating of the second magnetic, conductive metal particles.

2. The chip electronic component of claim 1, wherein each of the second magnetic, conductive metal particles includes the oxide coating and a core covered with the oxide coating, the oxide coating includes a chromium oxide, and an Fe content of the core is 85% or greater.

3. The chip electronic component of claim 1, wherein a D50 of the first magnetic metal particles and a D50 of the second magnetic, conductive metal particles are the same.

4. The chip electronic component of claim 1, wherein the insulation resistance layers cover the entire upper surface and the entire lower surface of the magnetic body.

5. The chip electronic component of claim 1, wherein the insulation resistance layers are further disposed on opposing side surfaces of the magnetic body.

6. The chip electronic component of claim 5, wherein the insulation resistance layers cover an entirety of the opposing side surfaces of the magnetic body.

7. The chip electronic component of claim 1, further comprising:

first and second external electrodes disposed on outer surfaces of the magnetic body to be connected to end portions of the internal coil parts, wherein the first and second external electrodes each include an external electrode layer and a plating layer disposed on the external electrode layer.

8. The chip electronic component of claim 7, wherein the insulation resistance layers are disposed on portions of upper and lower surfaces of the magnetic body not covered by the external electrode layers.

9. The chip electronic component of claim 7, wherein the insulation resistance layers are further disposed on portions of opposing side surfaces of the magnetic body not covered with the external electrode layers.

10. The chip electronic component of claim 7, wherein the plating layer includes at least one selected from the group consisting of nickel (Ni), copper (Cu), and tin (Sn).

11. The chip electronic component of claim 1, wherein the oxide coating includes a chromium oxide.

* * * * *